US007682238B2

(12) United States Patent
Chudd et al.

(10) Patent No.: US 7,682,238 B2
(45) Date of Patent: Mar. 23, 2010

(54) METHOD AND APPARATUS FOR PAYOUT IN A GAMING MACHINE

(75) Inventors: Russell Chudd, Reno, NV (US); Scott Gowin, Sparks, NV (US); Thomas D. Waxman, Reno, NV (US); Joseph R. Hedrick, Reno, NV (US); Daniel J. Waller, Reno, NV (US); John L. Beadell, Sparks, NV (US)

(73) Assignee: IGT, Reno, NV (US)

( * ) Notice: Subject to any disclaimer, the term of this patent is extended or adjusted under 35 U.S.C. 154(b) by 997 days.

(21) Appl. No.: 10/244,791

(22) Filed: Sep. 16, 2002

(65) Prior Publication Data

US 2004/0053684 A1 Mar. 18, 2004

(51) Int. Cl.

| | |
|---|---|
| ***A63F 13/00*** | (2006.01) |
| ***G07F 11/00*** | (2006.01) |
| *A24F 15/04* | (2006.01) |
| *G06F 17/00* | (2006.01) |
| *B65H 3/00* | (2006.01) |

(52) U.S. Cl. ..... 463/16; 463/25; 221/107; 221/24

(58) Field of Classification Search ..... 194/215, 194/225, 227, 351; 463/20, 16, 25; 221/24, 221/107

See application file for complete search history.

(56) References Cited

U.S. PATENT DOCUMENTS

| | | | | |
|---|---|---|---|---|
| 1,459,211 | A * | 6/1923 | Kalisz | 34/67 |
| 3,782,594 | A * | 1/1974 | Langieri et al. | 221/274 |
| 3,951,303 | A * | 4/1976 | Hobden et al. | 221/96 |
| 4,063,639 | A * | 12/1977 | Grant | 206/0.82 |
| 5,122,094 | A * | 6/1992 | Abe | 453/57 |
| 5,386,903 | A * | 2/1995 | Rothschild et al. | 194/350 |
| 5,397,125 | A * | 3/1995 | Adams | 463/20 |
| 5,655,961 | A * | 8/1997 | Acres et al. | 463/27 |
| 5,662,520 | A * | 9/1997 | Evdokimo | 453/3 |
| 5,807,172 | A * | 9/1998 | Piechowiak | 463/20 |
| 5,931,731 | A * | 8/1999 | Chwalisz | 453/32 |
| 6,085,937 | A | 7/2000 | Hutchinson et al. | 221/122 |
| 6,200,213 | B1 * | 3/2001 | Cole | 453/30 |
| 6,398,637 | B1 * | 6/2002 | Tsuchida | 453/57 |
| 6,543,639 | B1 * | 4/2003 | Kovens | 221/24 |

(Continued)

FOREIGN PATENT DOCUMENTS

| | | |
|---|---|---|
| EP | 0 764 925 | 3/1997 |

(Continued)

OTHER PUBLICATIONS

International Search Report (counterpart PCT application).

*Primary Examiner*—Peter DungBa Vo
*Assistant Examiner*—Frank M Leiva
(74) *Attorney, Agent, or Firm*—Weaver Austin Villeneuve & Sampson LLP

(57) ABSTRACT

A gaming apparatus includes a value output device. The value output device includes a frame, a hopper mounted to the frame having a hopper opening, an outlet spaced from the hopper opening, a first plate moveable relative to the hopper opening between a first position wherein the plate blocks the hopper opening and a second position wherein the plate is spaced from the hopper opening, and a carrier moveable between the outlet and the hopper opening.

37 Claims, 19 Drawing Sheets

U.S. PATENT DOCUMENTS

| | | | | |
|---|---|---|---|---|
| 6,843,720 | B2 * | 1/2005 | Luciano et al. | 463/16 |
| 2001/0014838 | A1 * | 8/2001 | Abe et al. | 700/226 |
| 2001/0034259 | A1 | 10/2001 | Luciano et al. | 463/16 |
| 2003/0089728 | A1 * | 5/2003 | Ostler et al. | 221/107 |
| 2003/0164379 | A1 * | 9/2003 | Casuccio | 221/76 |

FOREIGN PATENT DOCUMENTS

| | | |
|---|---|---|
| NL | 8801951 | 3/1990 |

* cited by examiner

FIG. 10
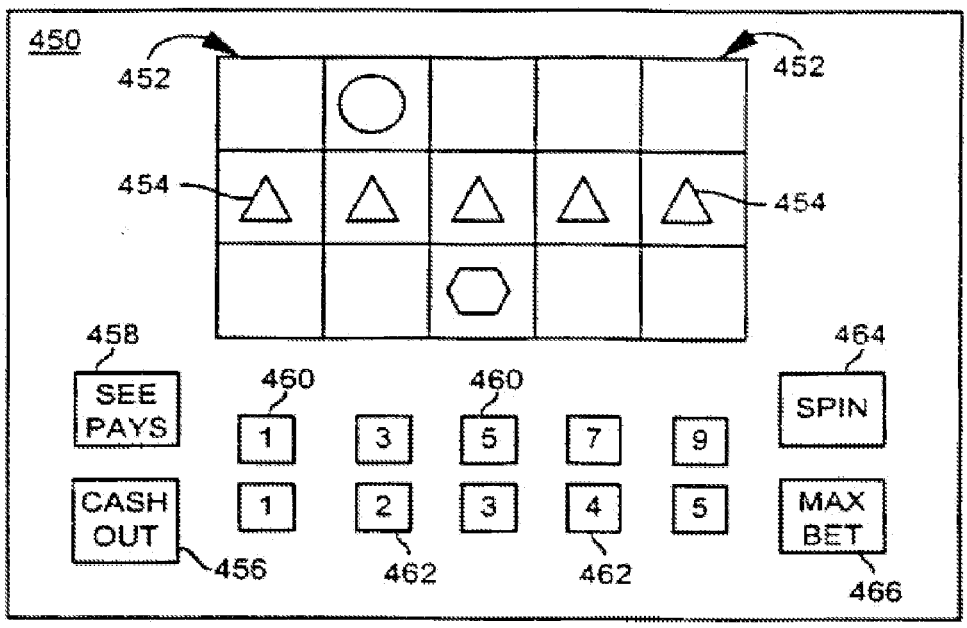
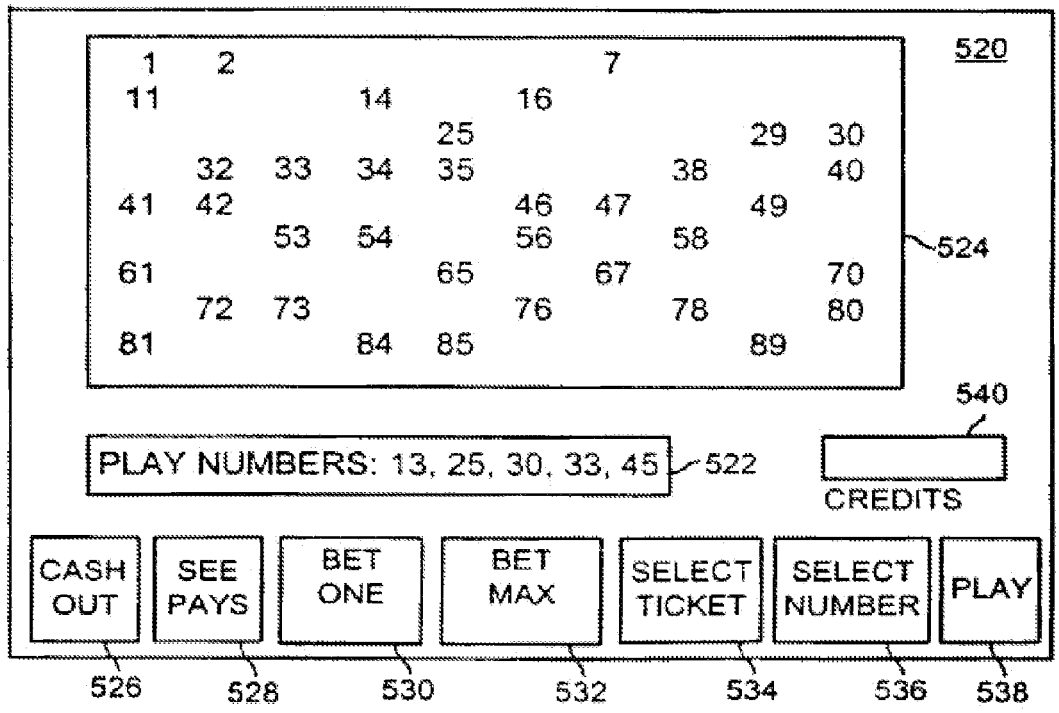
FIG. 11

METHOD AND APPARATUS FOR PAYOUT IN A GAMING MACHINE

BACKGROUND

The present disclosure is directed to a method and apparatus for operating a gaming machine, and in particular a method and apparatus for payout in a gaming machine.

It is known in the art to provide one or more mechanisms for providing a value payout to a player of a gaming machine. Commonly, one or more coin or token hoppers are mounted in the gaming machine housing, and coupled to the gaming machine's controller. In response to a game outcome associated with a value payout, the hoppers release a number of coins or tokens equal to the value payout. These coins or tokens are received and collected in a payout tray.

BRIEF DESCRIPTION OF THE DRAWING

FIG. 10 is an illustration of an embodiment of a visual display that may be displayed during performance of the slots routine of FIG. 12;

FIG. 11 is an illustration of an embodiment of a visual display that may be displayed during performance of the video keno routine of FIG. 13;

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
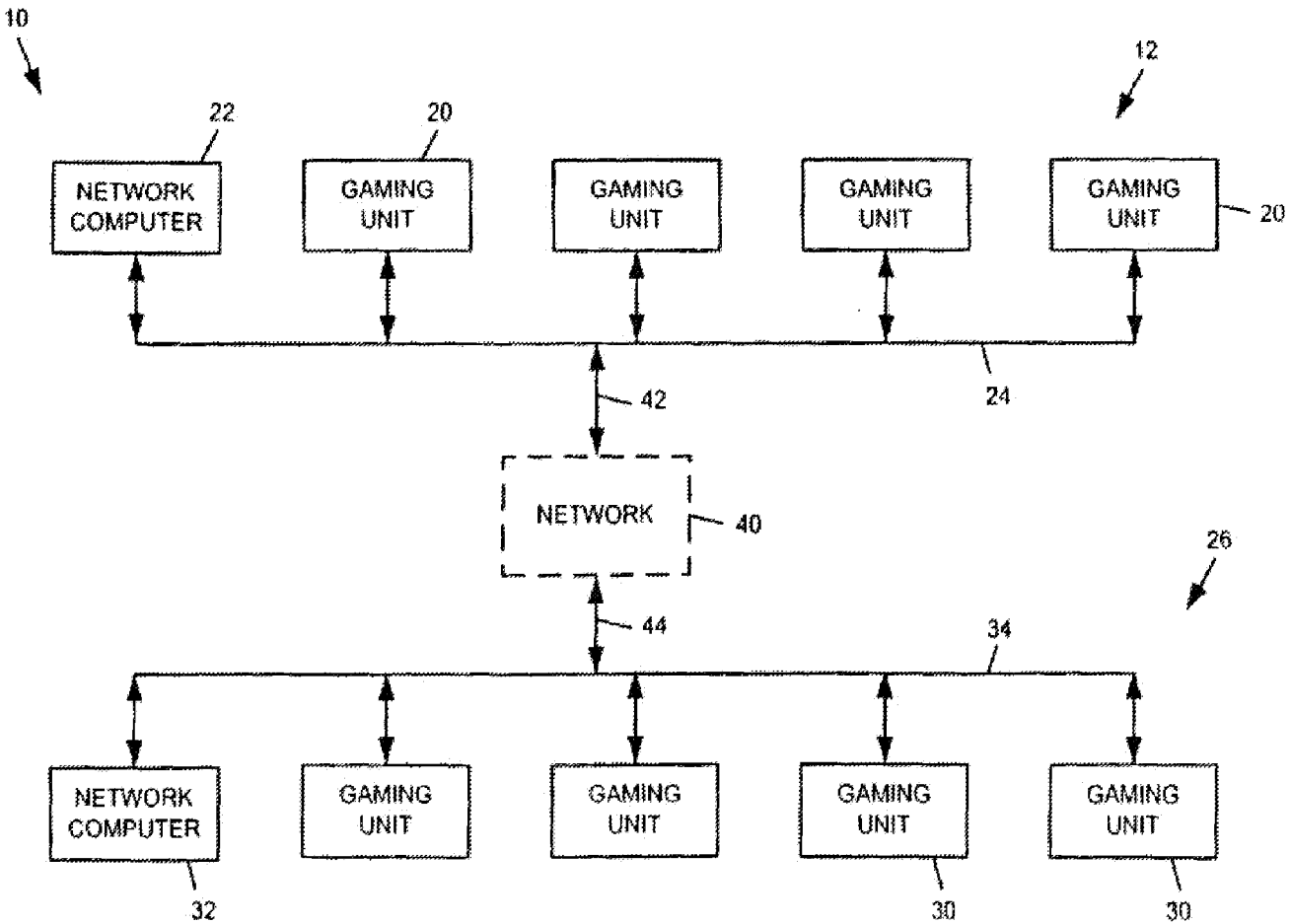
FIG. 1 is a block diagram of an embodiment of a gaming system in accordance with the invention.

FIG. 1 illustrates one possible embodiment of a casino gaming system 10 in accordance with the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Gaming Unit

Figure 2:
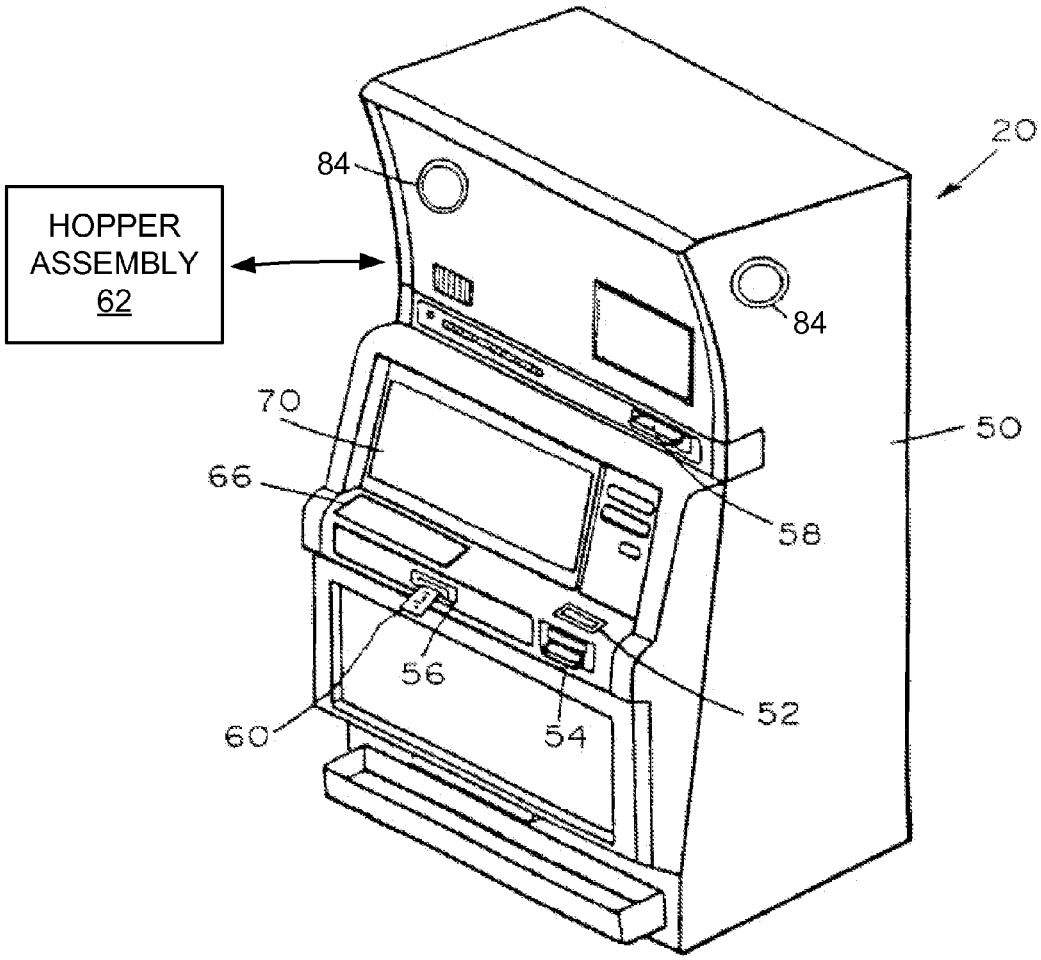
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, smart cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or to write data to, player tracking cards that are capable of storing data representing the identity of a player, the identity of a casino, the player's gaming habits, etc. The card reader 58 may also be used to read data from, and/or to write data to, a card that may be capable of storing data representing value awarded to the player based on game play for later use or redemption.

The gaming unit 20 may include value output devices other than the ticket reader/printer 56 and card reader 58. For example, the gaming unit 20 may have at least one hopper assembly 62, explained in greater detail below, associated with the gaming unit 20, which hopper assembly 62 may be used in addition to or in substitution for the ticket reader/printer 56 and/or card reader 58. The hopper assembly 62 may be disposed in the same housing as the gaming unit 20, or may be disposed in a top box attached to the gaming unit 20. Alternatively, the hopper assembly 62 may be disposed next to the gaming unit 20, or may be spaced remotely from the gaming unit 20 (such as in a central location relative to a bank of gaming units 20 and connected to the individual gaming units 20 by the link 24). The hopper assembly 62 may dispense value enclosed in a container, capsule, cover or the like into a tray disposed at the front of the housing 50. The value may be in the form of tangible items, for example such as gold coins, jewelry and collectors items. Alternatively, the value may be in the form of items that may be redeemed for goods or services, for example such as cruise tickets, airline tickets, show tickets, game play tickets or tokens, merchandise tickets or tokens, restaurant tickets or tokens, etc. As a further alternative, the value may be in the form or items that may be redeemed for goods or services, but it may take more tokens than may be included in a single container to redeem for a specific good or service.

Figure 2A:
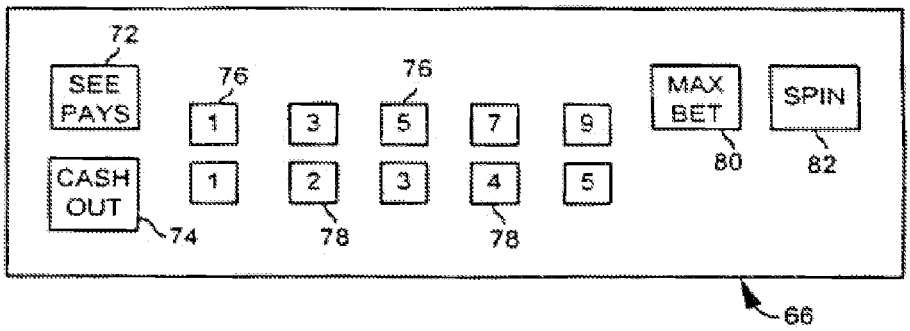
FIG. 2A illustrates an embodiment of a control panel for a gaming unit.

The gaming unit 20 may also include an input control panel 66. The input control panel 66 may be provided with a plurality of pushbuttons or touch sensitive areas that may be pressed by a player to select games, make wagers, make gaming decisions, etc. FIG. 2A illustrates one possible embodiment of the control panel 66, which may be used where the gaming unit 20 is a slot machine having a video output device in the form of a color video display unit 70 for displaying images of slot machine reels. While such an example is discussed herein, the gaming unit 20 is not limited to slot machines with video display unit outputs, but may include other forms of machines with video display unit outputs (e.g., video poker machines) or other forms of slot machines (e.g., slot machines with mechanical reels).

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74., 76, 78, 80, 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen or touch-sensitive pads.

The gaming unit 20 may include one or more audio output devices 84. The audio output devices 84 may be speakers, and may be capable of providing sounds that emanate or appear to emanate from a single point, that emanate or appear to emanate from multiple points, or that vary or appear to vary their point of emanation in two dimensional or three dimensional space. Other types of audio output devices 84 may include whistles, buzzers, bells, chimes, horns, etc. The audio output devices 84 may generate audio sound segments representing sounds such as the noise of spinning slot machine reels, a dealer's voice, music, announcements, etc.

Figure 2B:
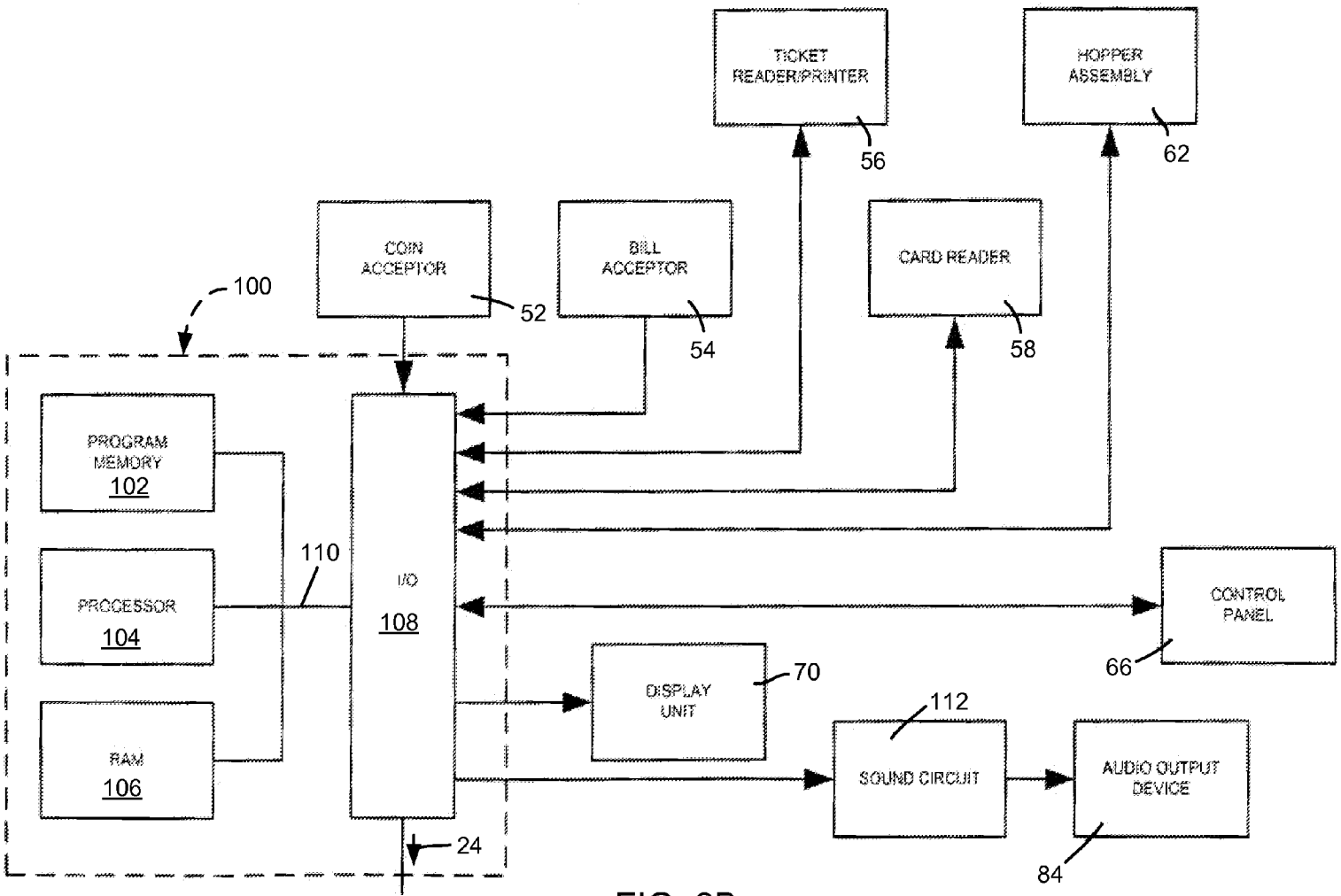
FIG. 2B is a block diagram of the electronic components of the gaming unit of FIG. 2.

FIG. 2B is a block diagram of a number of components that may be incorporated in the gaming unit 20. Referring to FIG. 2B, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

Although the program memory 102 is shown in FIG. 2B as a read-only memory (ROM) 102, the program memory of the controller 100 may be a read/write or alterable memory, such as a hard disk. In the event a hard disk is used as a program memory, the address/data bus 110 shown schematically in FIG. 2B may comprise multiple address/data buses, which may be of different types, and there may be an I/O circuit disposed between the address/data buses.

FIG. 2B illustrates that the coin acceptor 52, the bill acceptor 54, the ticket reader/printer 56, the card reader 58, the hopper assembly 62, the control panel 66, and the display unit 70 may be operatively coupled to the I/O circuit 108, each of those components being so coupled by either a unidirectional or bidirectional, single-line or multiple-line data link, which may depend on the design of the component that is used. The audio output devices 84 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 2B, the components 52, 54, 56, 58, 62, 66, 70, 112 may be connected to the I/O circuit 108 via a respective direct line or conductor. Different connection schemes could be used. For example, one or more of the components shown in FIG. 2B may be connected to the I/O circuit 108 via a common bus or other data link that is shared by a number of components. Furthermore, some of the components may be directly connected to the microprocessor 104 without passing through the I/O circuit 108.

Hopper Assembly

Figure 3A:
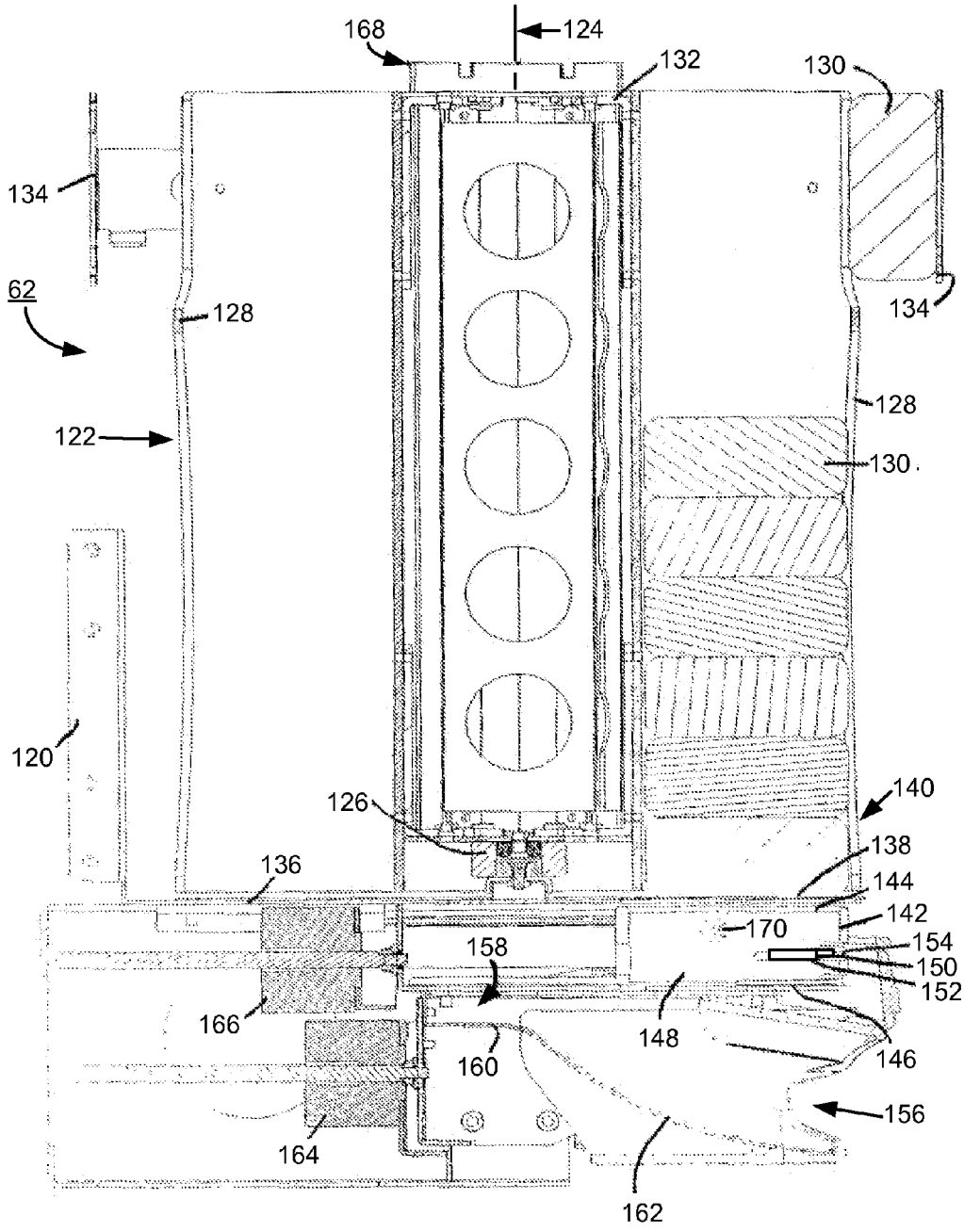
FIG. 3A is a cross-sectional view of a hopper assembly used in the gaming unit of FIG. 2 in a first operational state.

FIGS. 3A-3F show an exemplary embodiment of the hopper assembly 62 mentioned above in six different operational states. Referring to FIG. 3A, the hopper assembly 62 may include a mounting frame 120. A platform 122 may be mounted to the frame 120 for movement relative to the frame 120. As shown, the platform 122 may rotate about a longitudinal axis 124 relative to the frame 120, and the longitudinal axis 124 may represent a central axis. A bearing 126 is shown for rotatably mounting the platform 122 to the frame 120.

Associated with the platform 122 may be a plurality of hoppers 128 which in turn hold a plurality of containers 130. The number of hoppers 128 may be related to the size of the containers 130, for example. In the present example, the hopper assembly 62 may have six hoppers 128 associated therewith. Each of the hoppers 128 may be separately secured to a central cylindrical core 132, or the hoppers 128 may share common walls and be fashioned as an integrated whole. Each other the hoppers 128 may optionally have a container holder 134 associated therewith to display one of the containers 130 (and the value contained inside) that the individual hopper 128 dispenses.

The containers 130 in a given hopper 128 may have value contained therein that is the same for all containers 130 in the given hopper 128, but that varies from hopper to hopper. For example, one hopper 128 may have containers 130 that contain rings, while another hopper 128 may have containers 130 that contain necklaces, while still another hopper may have containers 130 that include earrings, and so on. On the other hand, more than one hopper 128 may have the same value contained in the containers 130, e.g., three of six hoppers 128 contain rings, while the other three hoppers 128 contain necklaces. As a further alternative, each hopper 128 may have containers 130 that contain items of value that are different. For example, all of the containers 130 in a given hopper 128 may contain jewelry of a relatively common value in terms of currency but differ in content or style, or all of the containers 130 may contain vouchers for travel on a given airline but the bottommost containers 128 expire sooner than those further up the hopper 128.

As an aside, while certain directional terms are used herein, such as bottom or top, those terms are for the convenience of orienting the reader to the embodiment of the hopper assembly 62 shown in the Figures. These directional terms should not be taken as dictating one particular orientation in use over another. That is, while the hopper assembly 62 is shown with its longitudinal axis 124 substantially vertical, in use the hopper assembly 62 may be placed at any angle relative to vertical as is desired. In uses where the longitudinal axis 124 may be at a significant angle relative to vertical, it may be desireable to include a mechanism to apply a force to the containers 130 in the hoppers 128 to cause them to move along the longitudinal axis 124 of the hopper 128. For example, each of the hoppers 128 may include a spring that has an end that abuts the topmost container 130, and applies a downward force on the containers 130 in the hopper 128. There may be other modifications that may be included as well, depending on the orientation of the hopper assembly 62.

Figure 3B:
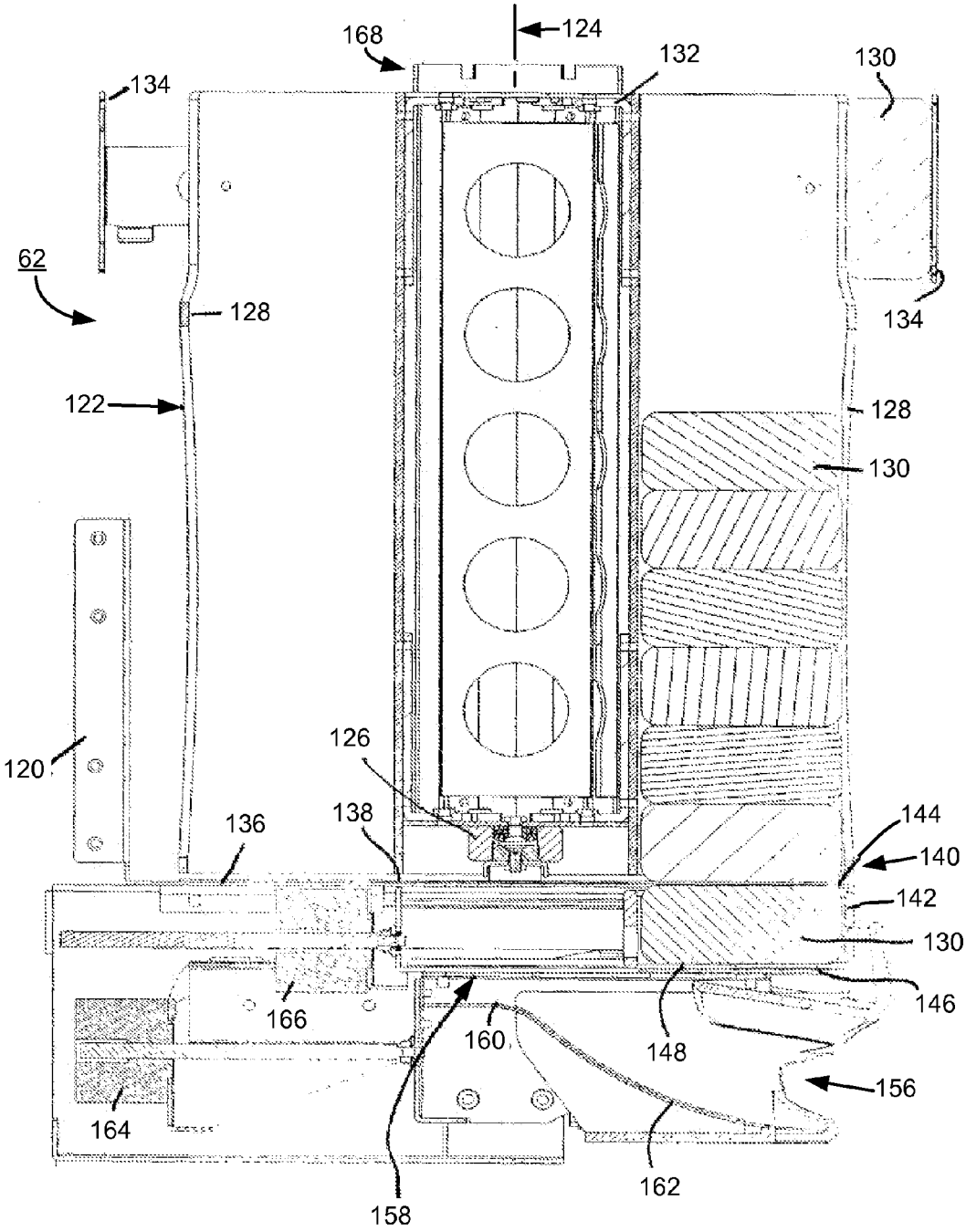
FIG. 3B is a cross-sectional view of a hopper assembly used in the gaming unit of FIG. 2 in a second operational state.

Returning to FIG. 3A, at the bottom of the platform 122 may be a first plate 136 and a second plate 138. Because there may be an open, lower end 140 to each of the hoppers 128, as the platform 122 revolves about its axis 124, the bottommost container 130 in each hopper 128 may move over the surface of the first plate 136. The bottommost container 130 may also move over the surface of the second plate 138, if the second plate 138 is in the state shown in FIG. 3A or 3C. However, the second plate 138 may be moveable relative to the frame 120, and as shown in FIG. 3B, the second plate 138 does not obstruct the movement of the containers 130 from the hopper 128.

A carrier 142 may be disposed below the platform 122. The carrier 142 may have a first state shown in FIGS. 3A-3C. With the carrier 142 in the state shown in FIGS. 3A-3C, a first opening 144 in the carrier 142 may be substantially aligned with the open end 140 of the hopper 128. With the moveable plate 138 in the state shown in FIG. 3B, the opening 144 may be in communication with the open end 140, such that the bottommost container 130 may pass from the hopper 128 into the carrier 142.

A stop plate 146 may prevent the container 130 from passing completely through the carrier 142, because the carrier 142 may have a second opening 148 defined opposite the first opening 144. In the alternative to the stop plate 146, where a container 130 of smaller height than that shown is used, an intermediate plate 150 may be disposed through a slit or opening 152 in the carrier 142 and a slit or opening 154 in the frame 120 as shown in FIG. 3A. The intermediate plate 150 may prevent the bottommost container 150 in the hopper 128 from falling so far into the carrier 142 that a second container 130 of smaller width than those shown in FIGS. 3A-3F may become wedged in between the carrier 142 and the hopper 128, and may impede the movement of the moveable plate 138.

Figure 3C:
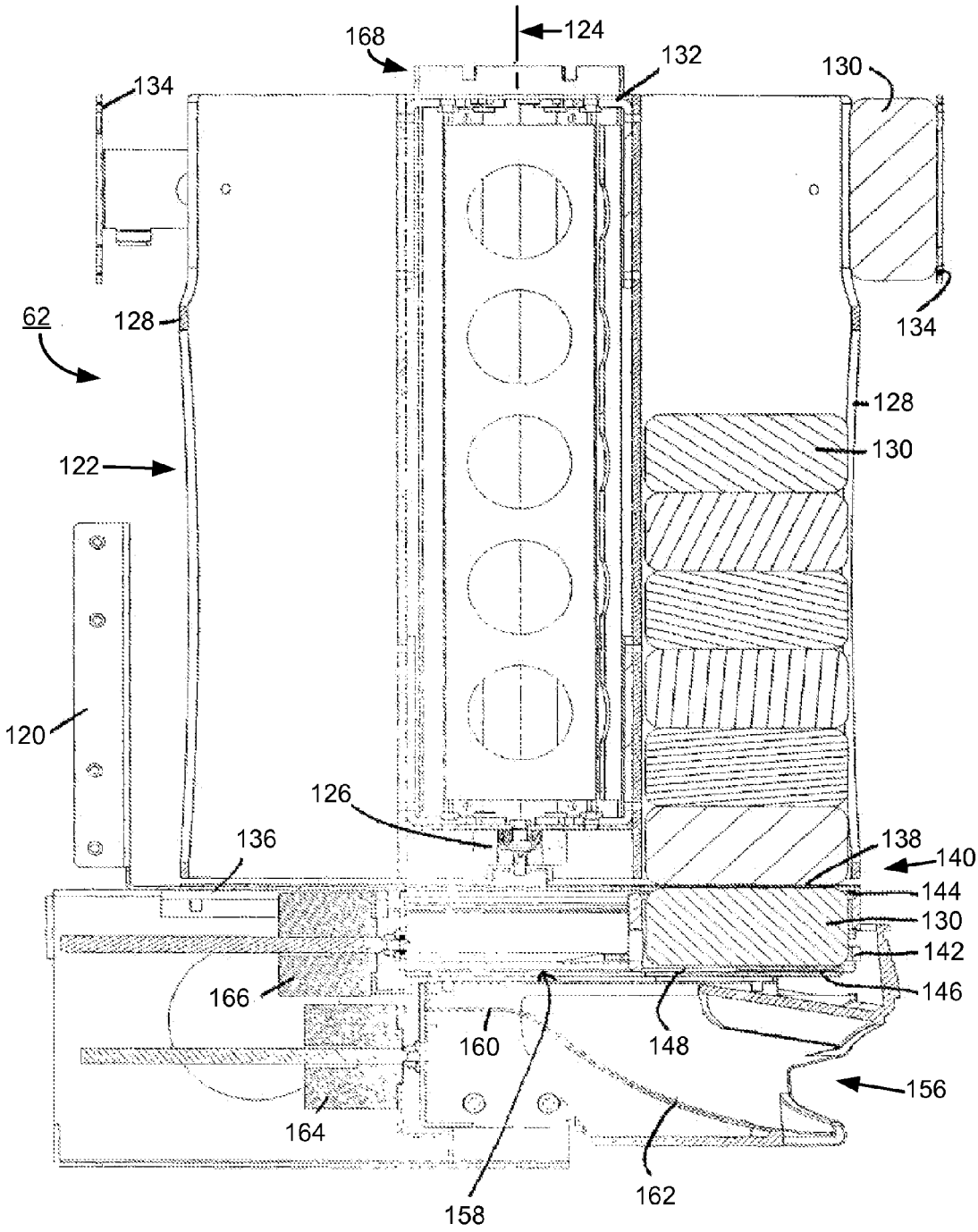
FIG. 3C is a cross-sectional view of a hopper assembly used in the gaming unit of FIG. 2 in a third operational state.
Figure 3D:
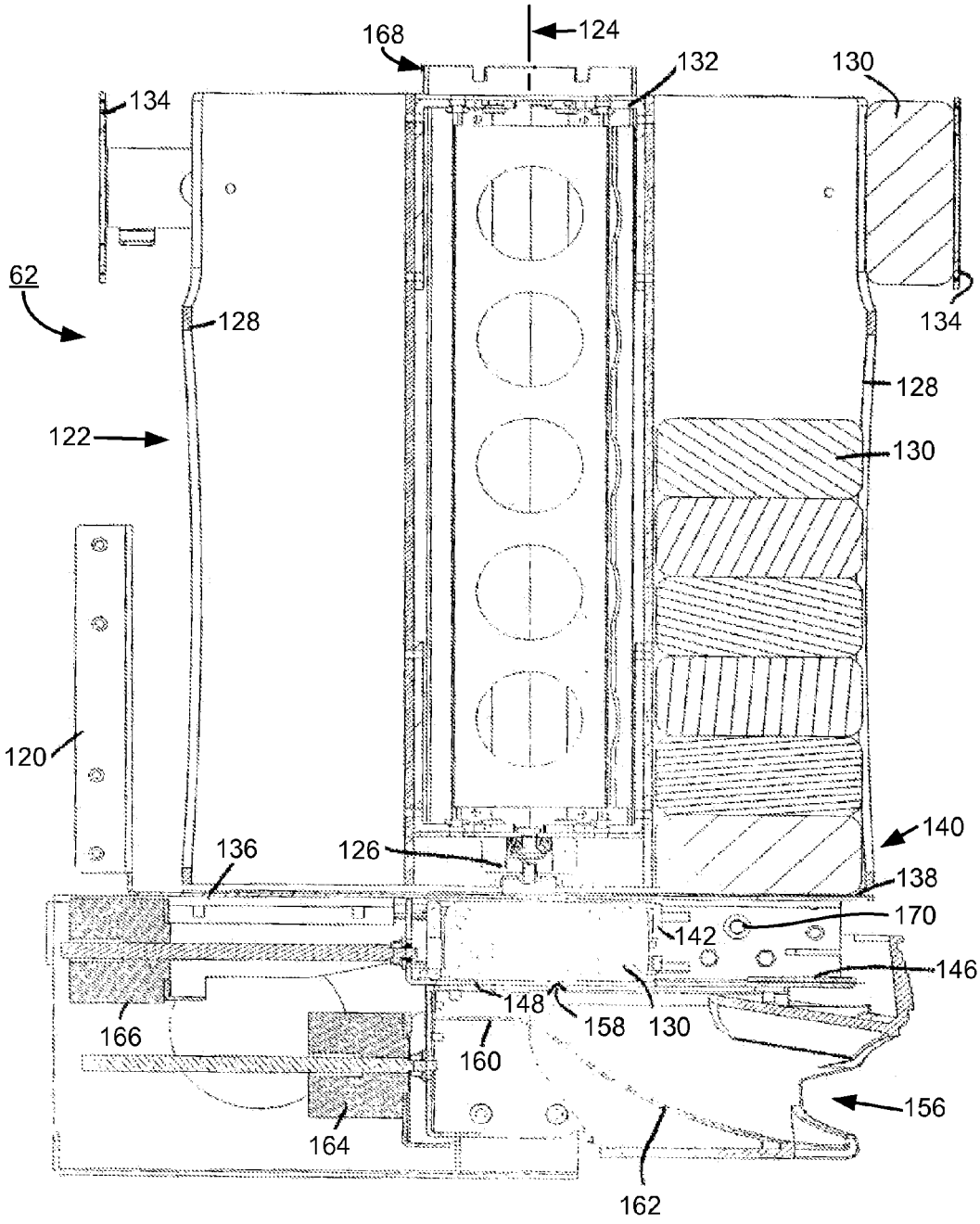
FIG. 3D is a cross-sectional view of a hopper assembly used in the gaming unit of FIG. 2 in a fourth operational state.
Figure 3E:
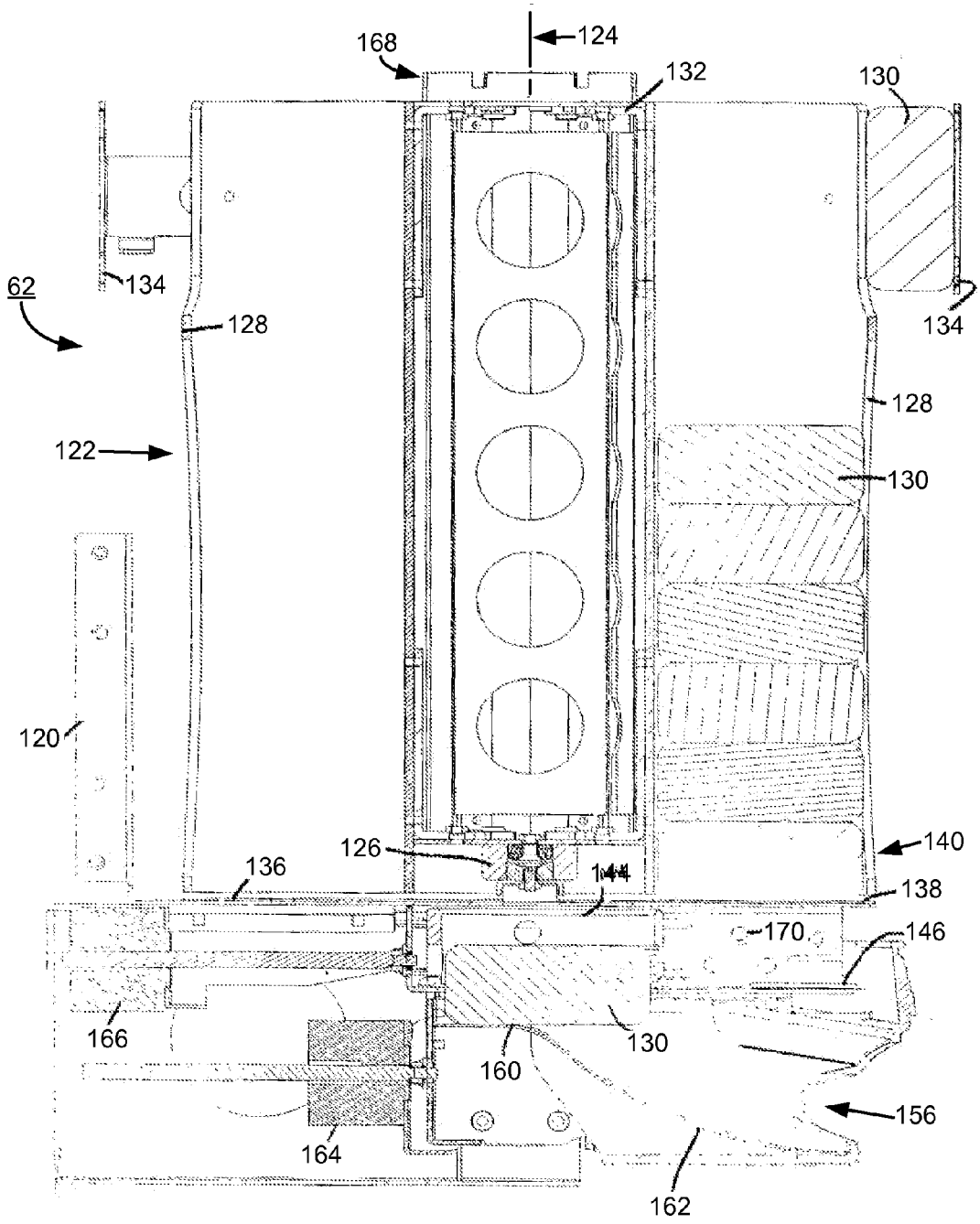
FIG. 3E is a cross-sectional view of a hopper assembly used in the gaming unit of FIG. 2 in a fifth operational state.
Figure 3F:
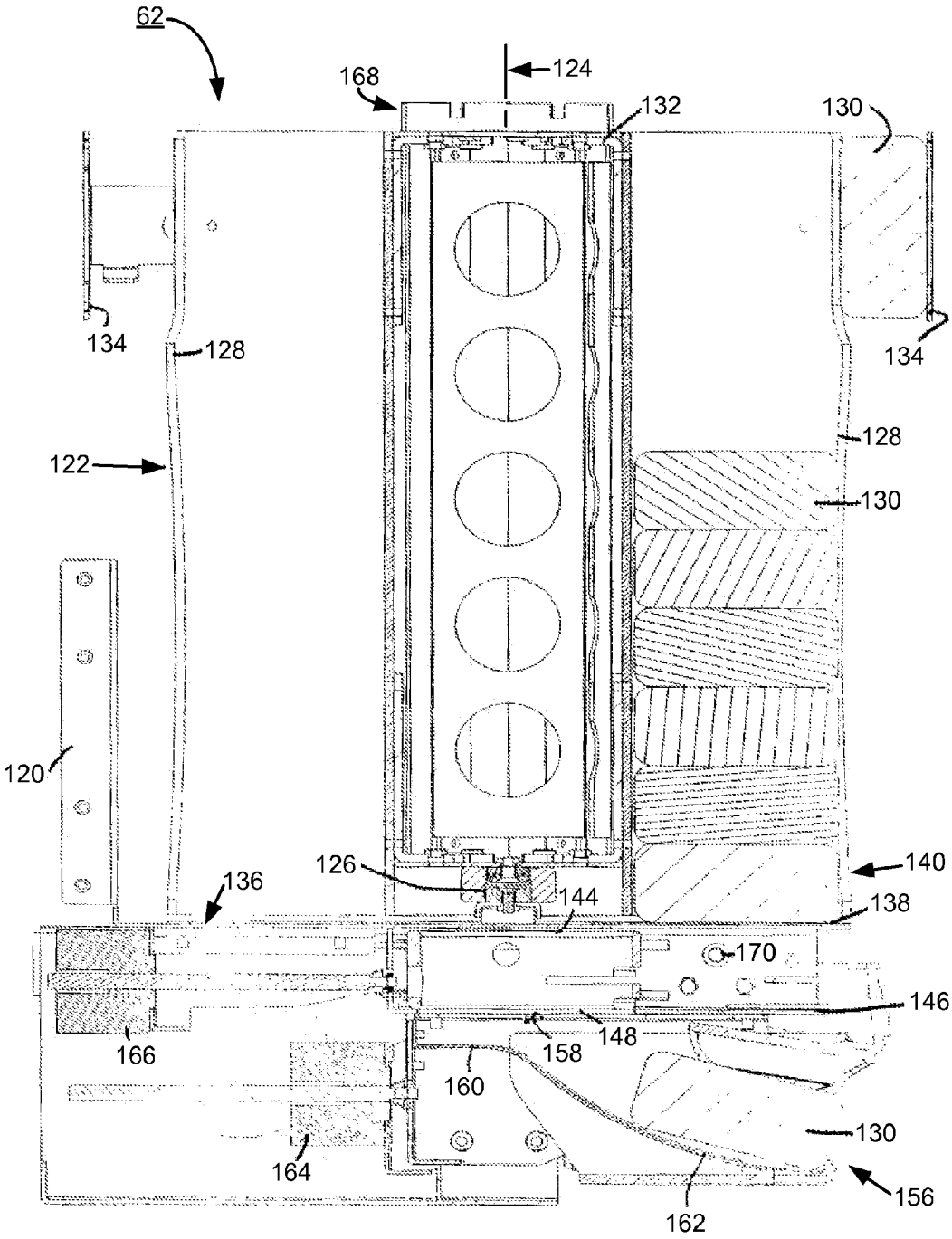
FIG. 3F is a cross-sectional view of a hopper assembly used in the gaming unit of FIG. 2 in a sixth operational state.

The carrier 142 may also have a second state, as shown in FIGS. 3D-3F. In the second state, the second opening 148 is in communication with an outlet 156, such that a container 130 may pass from the carrier 142 to the outlet 156 and into a tray (not shown). The outlet 156 may include a first opening 158 that may be substantially aligned with the second opening 148 in the carrier 142 in the state shown in FIGS. 3D-3F, which permits the container 130 in the carrier 142 to pass from the carrier 142 into the outlet 156, and contact a ledge or lip 160 at the top of a ramp 162.

The hopper assembly 62 also may also include mechanisms to move the plate 138 and the carrier 142 relative to the frame 120. The mechanisms may be motors in the form of linear actuators 164, 166. In particular, the linear actuator 164 may be associated with the plate 138 to move the plate between the position shown in FIG. 3A and that shown in FIG. 3B, for example. The linear actuator 166 may be associated with the carrier 142, and may move the carrier 142 between the position shown in FIGS. 3A-3C and the position shown in FIGS. 3D-3F.

The hopper assembly 62 may further include sensors to sense the movement of the various structures of the hopper assembly 62. For example, an optical sensor 168 may be mounted on the top of the platform 122 and may be used to note the position of the platform 122 relative to the frame 120. An second optical sensor 170 may be mounted to the frame 120 and may be used to determine whether a container 130 is in the carrier 142. Additional optical sensors (not shown) may be included to sense the position of the plate 138 and the carrier 142, and used in combination with an arrangement of optical flags (indicating different signals at various points throughout the travel of the plate 138 and carrier 142) to allow these components to be located upon power-up and to find "home" position without overtravel causing collisions between the moving and stationary structures. Further optical sensors (also not shown) may be included to sense the level of the containers 130 in each hopper 128.

As noted above, the hopper assembly 62 may be coupled to the I/O circuit 108. More particularly, the linear actuators 164, 166 may be coupled to the controller 100 to move the plate 138 and the carrier 142. Also, the sensors 168, 170 may be coupled to the controller 100 to provide information about the status of the relative position between the platform 122 and the frame 120, the relative position between the containers 130 and the carrier 142, the positions of the plate 138 and carrier 142, and the level of containers 130 in the hoppers 128.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C++, C#, Java or the like or any lowlevel assembly or machine language. By storing the computer program portions therein, various portions of the memories 102, 106 are physically and/or structurally configured in accordance with computer program instructions.

Figure 4:
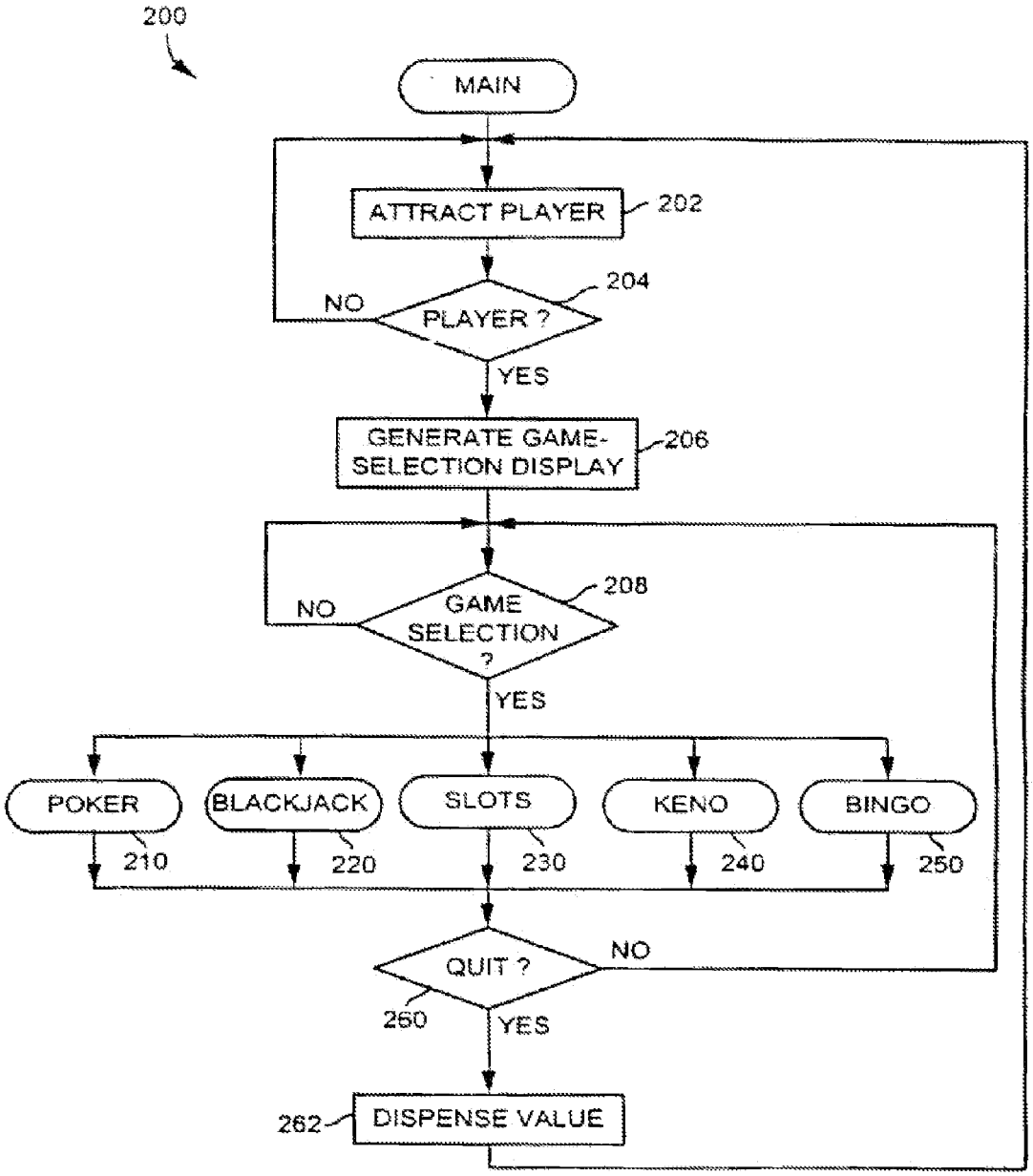
FIG. 4 is a flowchart of an embodiment of a main routine that may be performed during operation of one or more of the gaming units.

FIG. 4 is a flowchart of a main operating routine 200 that may be stored in the memory of the controller 100. Referring to FIG. 4, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the controller 100 may cause one of a number of game routines to be performed to allow the selected game to be played. For example, the game routines could include a video poker routine 210, a video blackjack routine 220, a slots routine 230, a video keno routine 240, and a video bingo routine 250. At block 208, if no game selection is made within a given period of time, the operation may branch back to block 202.

After one of the routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player, using the hopper assembly 62, for example, at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 4, a different number of routines could be included to allow play of a different number of games. The gaming unit 20 may also be programmed to allow play of different games.

Figure 5:
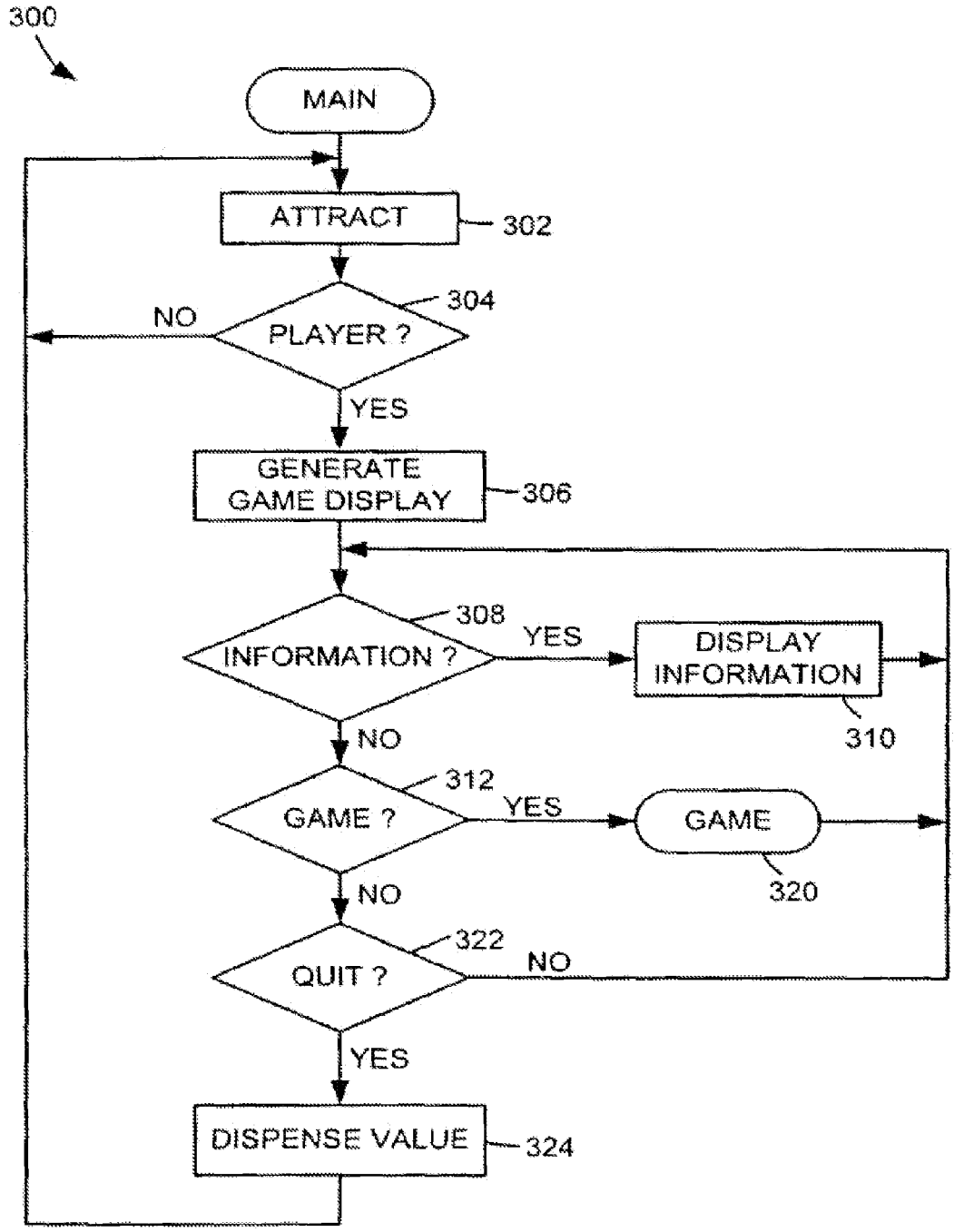
FIG. 5 is a flowchart of an alternative embodiment of a main routine that may be performed during operation of one or more of the gaming units.

FIG. 5 is a flowchart of an alternative main operating routine 300 that may be stored in the memory of the controller 100. The main routine 300 may be utilized for gaming units 20 that are designed to allow play of only a single game or single type of game. Referring to FIG. 5, the main routine 300 may begin operation at block 302 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the casino game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 210, 220, 230, 240, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 324 based on the outcome of the game(s) played by the player. The operation may then return to block 302. If the player did not wish to quit as determined at block 322, the operation may return to block 308.

Video Poker

Figure 6:
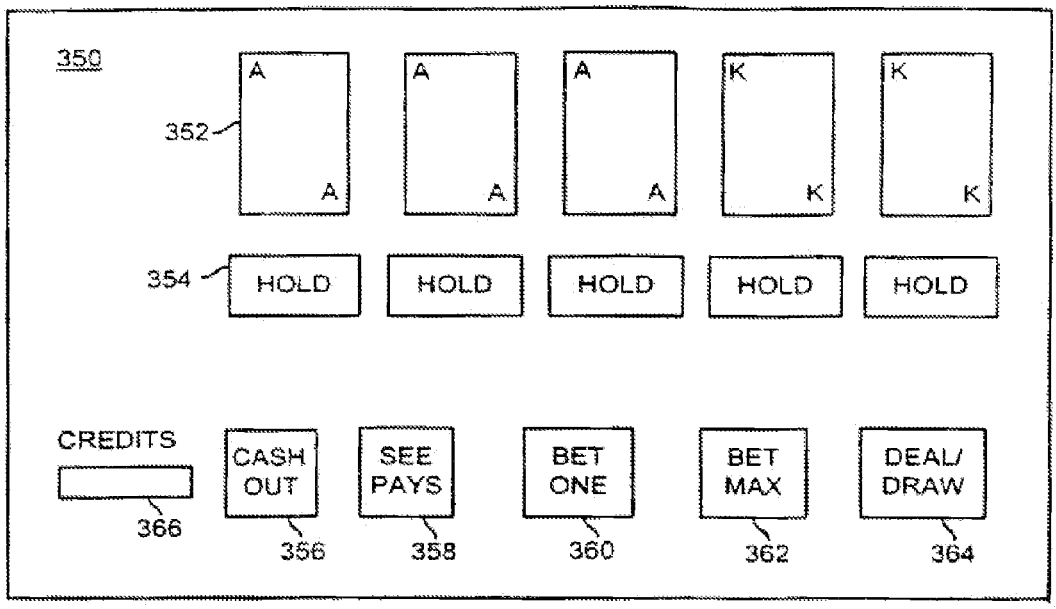
FIG. 6 is an illustration of an embodiment of a visual display that may be displayed during performance of the video poker routine of FIG. 8.

FIG. 6 is an exemplary display 350 that may be shown on the display unit 70 during performance of the video poker routine 210 shown schematically in FIG. 4. Referring to FIG. 6, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 8:
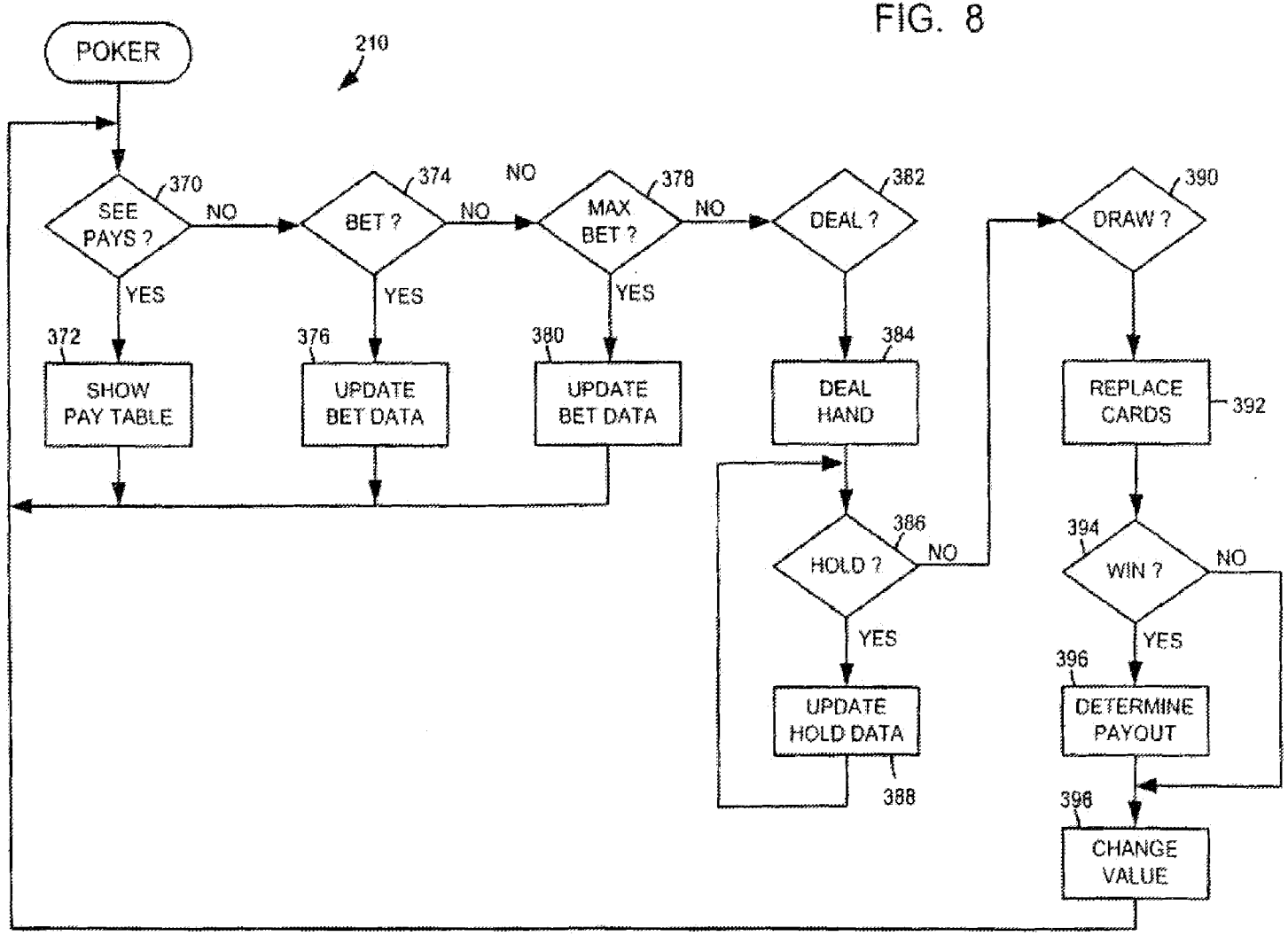
FIG. 8 is a flowchart of an embodiment of a video poker routine that may be performed by one or more of the gaming units.

FIG. 8 is a flowchart of the video poker routine 210 shown schematically in FIG. 4. Referring to FIG. 8, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100. At block 378, the routine may determine whether the player has pressed the "Bet Max Credits" button 362, in which case at block 380 bet data corresponding to the maximum allowable bet may be stored in the memory of the controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 6).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 7:
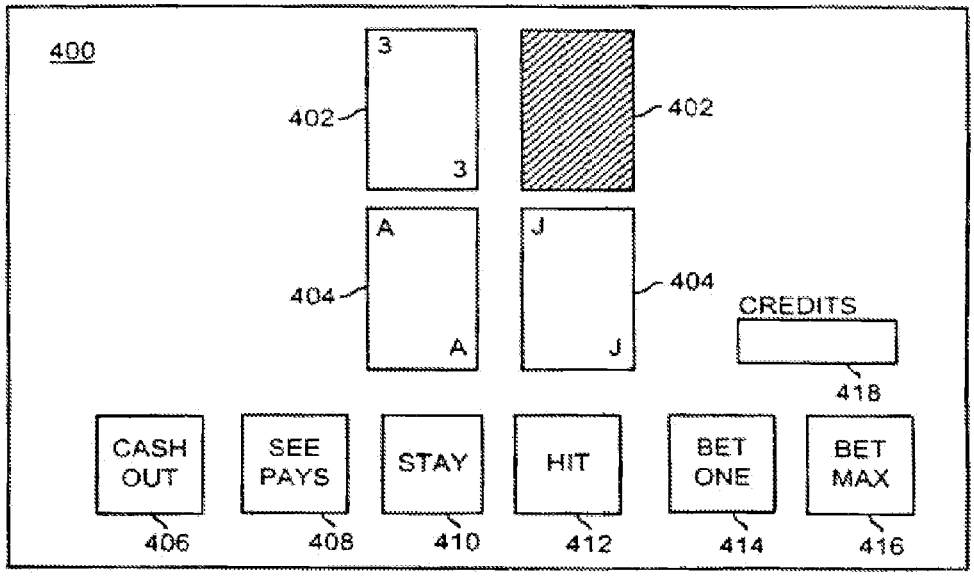
FIG. 7 is an illustration of an embodiment of a visual display that may be displayed during performance of the video blackjack routine of FIG. 9.

FIG. 7 is an exemplary display 400 that may be shown on the display unit 70 during performance of the video blackjack routine 220 shown schematically in FIG. 4. Referring to FIG. 7, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 9:
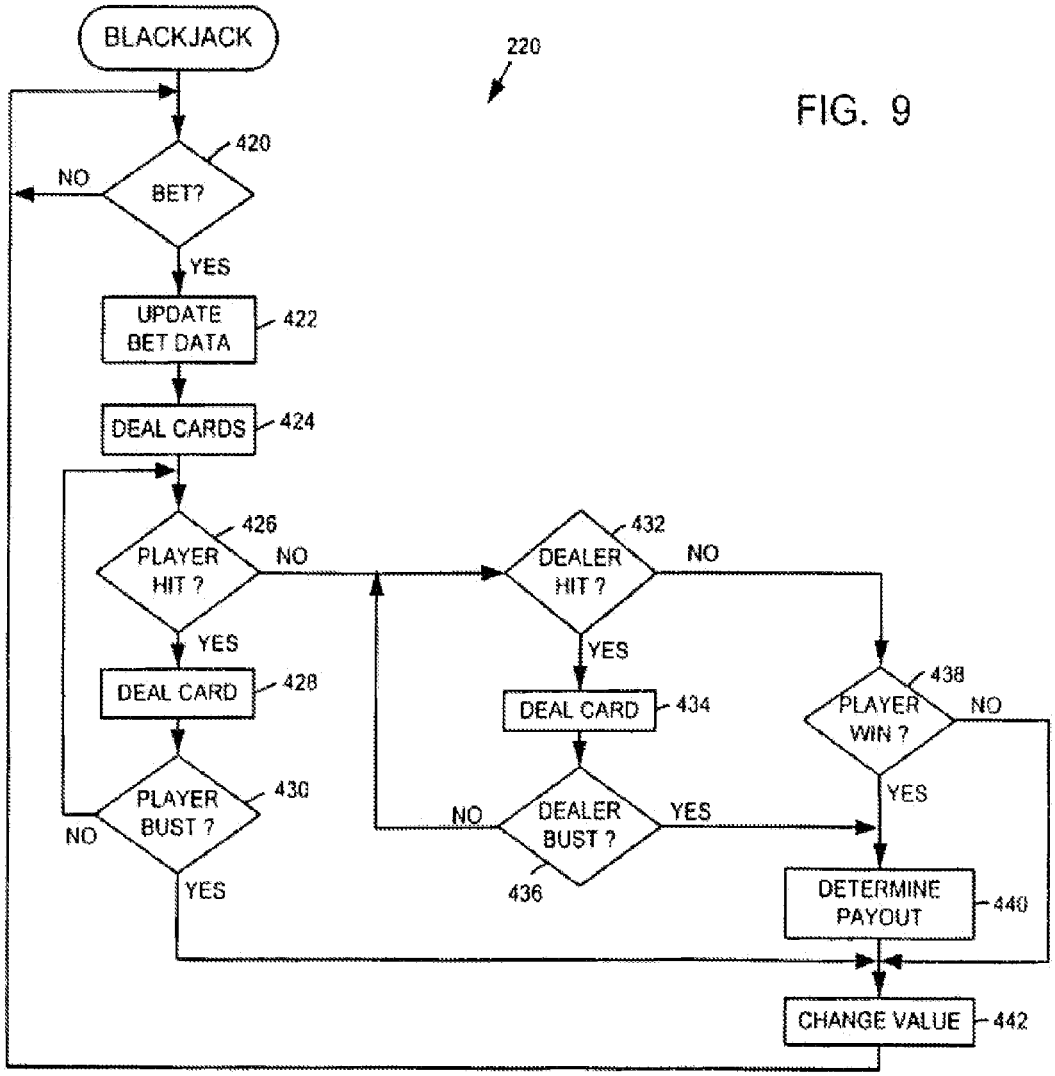
FIG. 9 is a flowchart of an embodiment of a video blackjack routine that may be performed by one or more of the gaming units.

FIG. 9 is a flowchart of the video blackjack routine 220 shown schematically in FIG. 4. Referring to FIG. 9, the video blackjack routine 220 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the controller 100. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 440. The cumulative value or number of credits may also be displayed in the display area 418 (FIG. 7).

Slots

FIG. 10 is an exemplary display 450 that may be shown on the display unit 70 during performance of the slots routine 230 shown schematically in FIG. 4. Referring to FIG. 10, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 12:
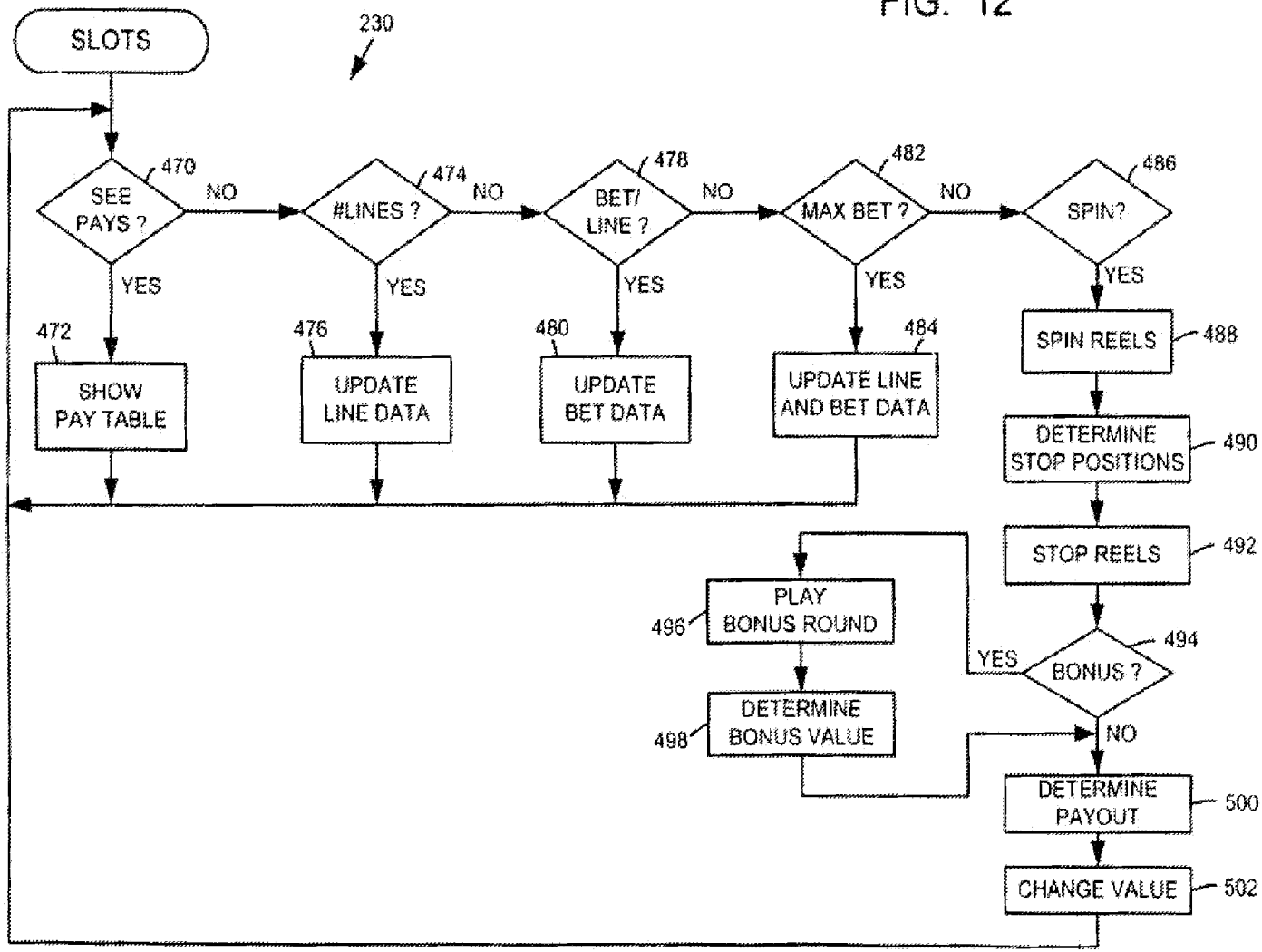
FIG. 12 is a flowchart of an embodiment of a slots routine that may be performed by one or more of the gaming units.

FIG. 12 is a flowchart of the slots routine 230 shown schematically in FIG. 10. Referring to FIG. 12, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100. At block 482, the routine may determine whether the player has pressed the "Max Bet" button 466, in which case at block 484 bet data (which may include both payline data and bet-per-payline data) corresponding to the maximum allowable bet may be stored in the memory of the controller 100.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 11 is an exemplary display 520 that may be shown on the display unit 70 during performance of the video keno routine 240 shown schematically in FIG. 4. Referring to FIG. 11, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 13:
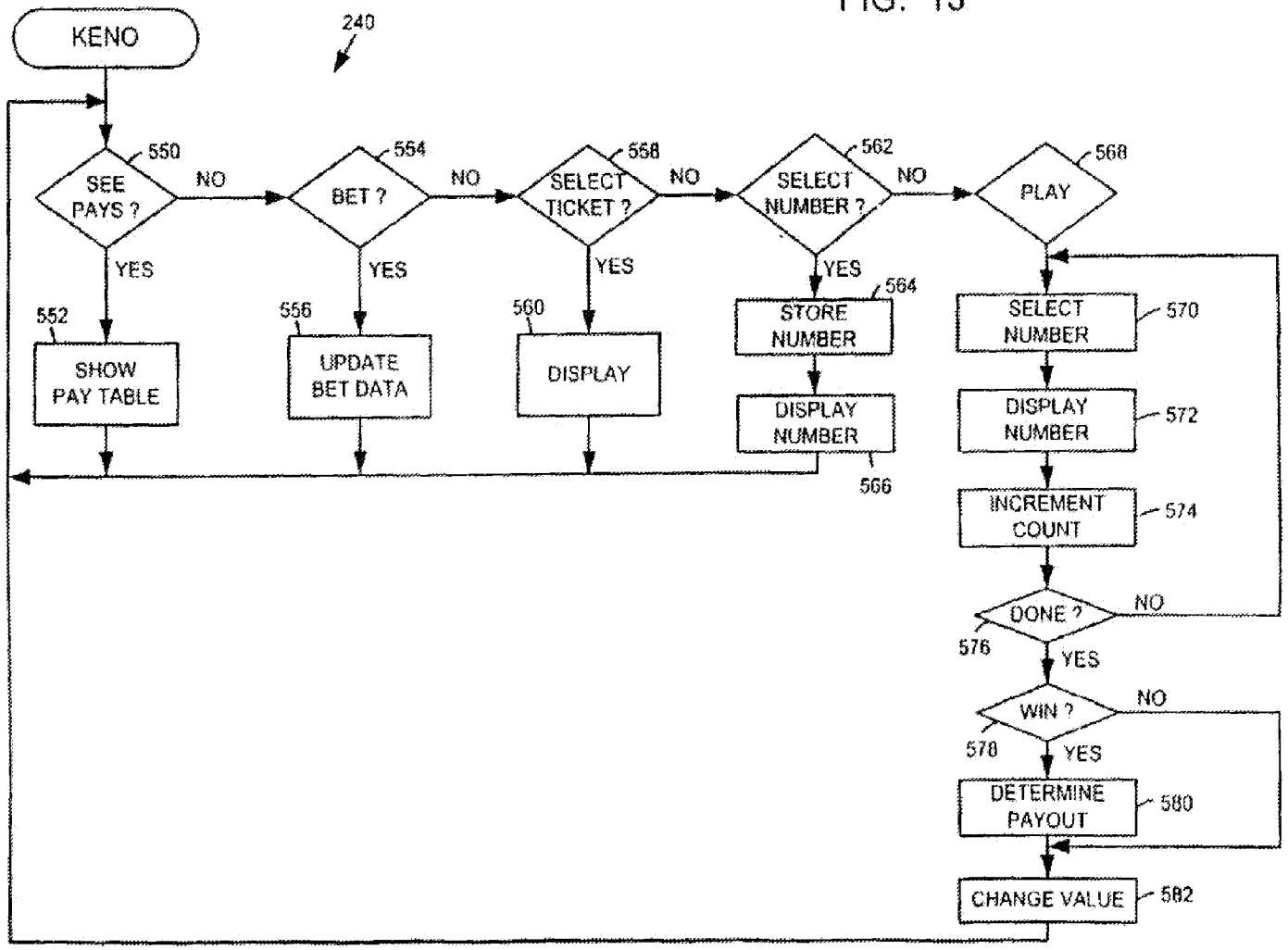
FIG. 13 is a flowchart of an embodiment of a video keno routine that may be performed by one or more of the gaming units.

FIG. 13 is a flowchart of the video keno routine 240 shown schematically in FIG. 4. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 13, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 11).

Video Bingo

Figure 14:
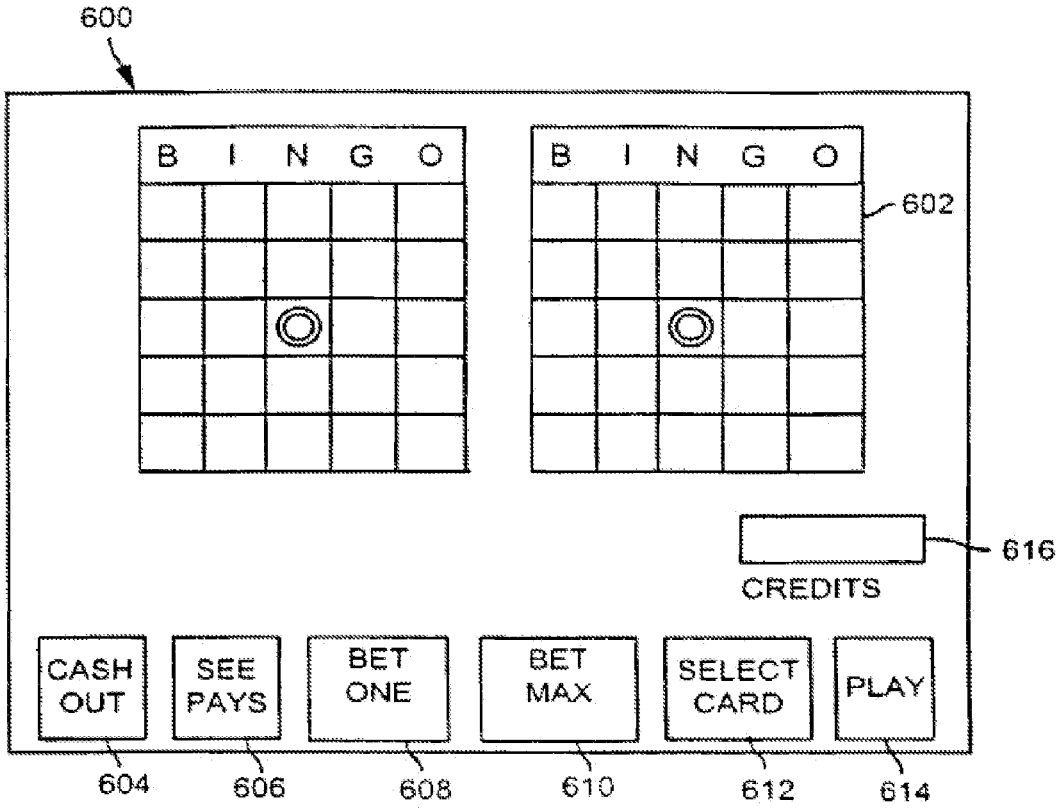
FIG. 14 is an illustration of an embodiment of a visual display that may be displayed during performance of the video bingo routine of FIG. 15.

FIG. 14 is an exemplary display 600 that may be shown on the display unit 70 during performance of the video bingo routine 250 shown schematically in FIG. 4. Referring to FIG. 14, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 15:
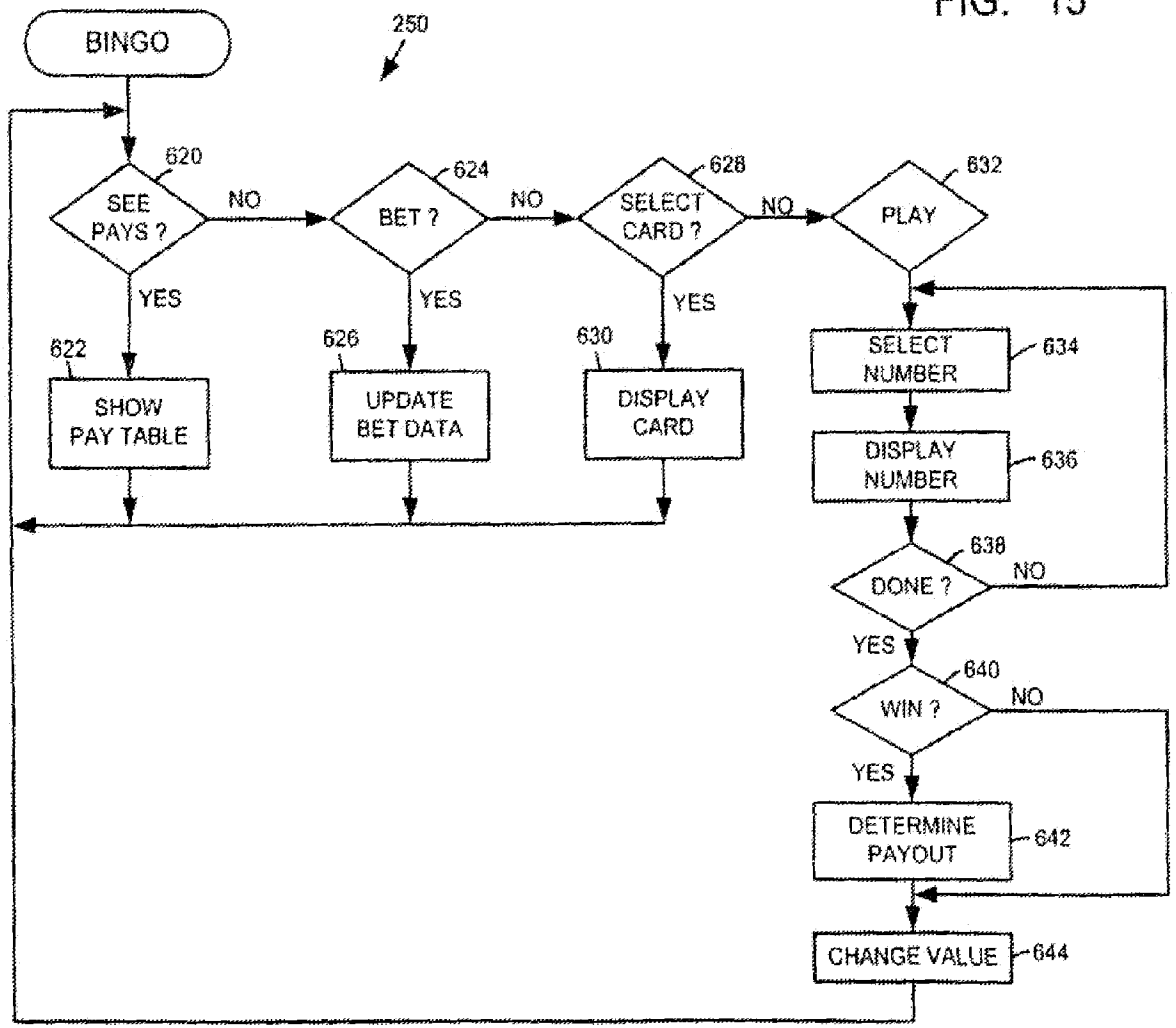
FIG. 15 is a flowchart of an embodiment of a video bingo routine that may be performed by one or more of the gaming units.

FIG. 15 is a flowchart of the video bingo routine 250 shown schematically in FIG. 4. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 15, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 14).

Operation of the Hopper Assembly

Referring again to FIGS. 3A-3F, the operation of the hopper assembly 62 is discussed in greater detail.

The hopper assembly 62 may include one or more buttons (not shown) that are coupled to the controller 100. The buttons may send signals to the controller 100 to cause the platform 122 and the hoppers 128 of the hopper assembly 128 to rotate about the longitudinal axis 124 until the individual hopper 128 of the player's selection may be aligned in the state shown in FIG. 3A. Alternatively, the movement of the platform 122 and hoppers 128 about the longitudinal axis 124 may be controlled directly by the controller 100, independent of the player. Such control may be used where the individual hoppers 128 contain value items that may be awardable for different game outcomes, for example, one hopper 128 contains value items awardable as a lower value prize, another hopper 128 as mid-range prizes, a third hopper 128 as higher-range prizes, a fourth hopper 128 as primary bonus prizes, a fifth hopper 128 as secondary bonus prizes, and so on. Also, such control may be used where more than one of the hoppers 128 contains a common value item, and the multiple hoppers 128 are used to limit the number of times the hopper assembly 128 needs restocking. In fact, a hybrid control may be used where more than one of the hoppers 128 contains a similar value item but more than one type of value item is offered, the player being given the option among the different types of value items, and the controller 100 indexing the platform 122 and hoppers 128 to which ever hopper 128 dispenses that type of value item and has that type of value item still in stock (e.g. the hopper 128 on the right-hand side of FIG. 3A as opposed to the hopper on the left-hand side of FIG. 3A).

So, in FIG. 3A, the platform 122 may be moved relative to the frame 120 such that the open end 140 of one of the hoppers 128 may be substantially aligned with the opening 144 in the carrier 142. In this state, the plate 138 may be moved relative to the hopper 128 and the carrier 142 so as to prevent the bottommost container 130 from passing from the hopper 128 into the carrier 142.

In FIG. 3B, the plate 138 may be moved, using actuator 164, so that the open end 140 of one of the hoppers 128 is in communication with the opening 144 in the carrier 142. As shown, the bottommost container 130 may move from the hopper 128 into the carrier 142. With the plate 138 returned to its first state, as shown in FIG. 3C, movement of additional containers 130 out of the aligned hopper 128 may be limited.

In FIG. 3D, the carrier 142 may be moved from the state shown in FIGS. 3A-3C, using linear actuator 166, to the state wherein the opening 148 may be aligned with the outlet 156. The container 130 may passes from the carrier 142 through the opening 158 to the ledge 160, as shown in FIG. 3E, and down the ledge 160 and the ramp 162, as shown in FIG. 3F, to a payout tray (not shown). The carrier 142 may then be returned to the state shown in FIG. 3A, and the hopper assembly 62 may be ready to dispense another container 130 from one of the hoppers 128.

While a method of operation of the hopper assembly 62 has been discussed above relative to the dispensing of a single container 130, the method may be repeated to dispense more than one container 130 from the hopper assembly 62 before moving the platform 122 again. Alternatively, the method of operation may be repeated after the hopper assembly 62 has been moved. Other methods of operation may be possible as well.

What is claimed is:

1. A gaming apparatus, comprising:

a display unit that is capable of generating video images;

a value input device;

a value output device comprising:

a frame, one or more hoppers mounted to the frame and adapted to hold one or more containers, the one or more hoppers moveable relative to a hopper opening, an outlet spaced from the hopper opening, a first plate moveable relative to the hopper opening between a first position wherein the first plate blocks the hopper opening and a second position wherein the first plate is spaced from the hopper opening, and a carrier having a receptacle formed to receive one and only one container therein from one of the hoppers and defining a carrier inlet and a spaced carrier outlet to the receptacle, the entire carrier moveable between a first position wherein the carrier outlet is adjacent the outlet and a second position wherein the carrier inlet is adjacent the hopper opening, wherein the entire carrier is moveable relative to the first plate, wherein the one or more hoppers are moveable relative to the carrier and the first plate, the container containing at least one item of value therein; and a controller operatively coupled to said display unit, said value input device, and said value output device, said controller comprising a processor and a memory operatively coupled to said processor, said controller being programmed to allow a person to make a wager, said controller being programmed to cause a video image representing a game to be generated on said display unit, said video image representing one of the following games: video poker, video blackjack, video slots, video keno or video bingo, said video image comprising an image of at least five playing cards if said game comprises video poker, said video image comprising an image of a plurality of simulated slot machine reels if said game comprises video slots, said video image comprising an image of a plurality of playing cards if said game comprises video blackjack, said video image comprising an image of a plurality of keno numbers if said game comprises video keno, said video image comprising an image of a bingo grid if said game comprises video bingo, said controller being programmed to determine a value payout associated with an outcome of said game, said controller being programmed to move the first plate from the first position to the second position with the carrier in the second position to permit one and only one container to enter the receptacle in the carrier, said controller being programmed to move the first plate from the second position to the first position, said controller being programmed to move the entire carrier from the second position to the first position with the first plate in the second position to provide the value payout in the form of the at least one item of value contained in the one and only one container, and said controller being programmed to move the one or more hoppers relative to the hopper opening.

2. The gaming apparatus as defined in claim 1, further comprising a housing having an inside and an outside, the display unit, the value input, and the controller disposed in the housing and the value output device attached to the outside of the housing.

3. The gaming apparatus as defined in claim 1, further comprising a housing, the display unit, the value input, and the controller disposed in the housing, and the value output device spaced from the housing.

4. The gaming apparatus as defined in claim 1, further comprising a platform rotatably mounted to the frame, the one or more hoppers attached to the platform.

5. The gaming apparatus as defined in claim 4, further comprising a plurality of hoppers, including the one or more hoppers, attached to the platform.

6. The gaming apparatus as defined in claim 5, wherein each of the hoppers has a plurality of containers disposed therein, each of the plurality of containers disposed in each of the hoppers containing at least one item of a different value.

7. The gaming apparatus as defined in claim 5, the platform having a central core and the plurality of hoppers attached to and spaced about the central core.

8. The gaming apparatus as defined in claim 1, further comprising first and second motors, the first motor coupled to the first plate and a second motor coupled to the carder.

9. The gaming apparatus as defined in claim 8, wherein the first plate is slideable relative to the hopper opening between the first and second position, and the carrier is slideable between the outlet and the hopper opening.

10. The gaming apparatus as defined in claim 9, wherein the first and second motors comprise first and second linear actuators.

11. The gaming apparatus as defined in claim 10, wherein the controller is coupled to the first and second motors: the controller being programmed to move the plate between the first and second positions with the carrier aligned with the hopper opening; and the controller being programmed to move the carrier between the hopper opening and the outlet with the plate in the first position.

12. The gaming apparatus as defined in claim 1, wherein the carrier has a first opening disposed on a first side of the carrier, alignable and disposable in communication with the hopper opening, and a second opening on a second, opposite side of the carrier, alignable and disposeable in communication with the outlet, the first opening in communication with the second opening.

13. A gaming apparatus, comprising:

a display unit that is capable of generating video images;

a value input device;

a value output device comprising:

a frame, one or more hoppers mounted to the frame and adapted to hold one or more containers, the one or more hoppers moveable relative to a hopper opening, an outlet spaced from the hopper opening, a first plate moveable relative to the hopper opening between a first position wherein the first plate blocks the hopper opening and a second position wherein the first plate is spaced from the hopper opening, and a carrier having a receptacle formed to receive one and only one container therein from one of the hoppers and defining a carrier inlet and a spaced carrier outlet to the receptacle, the entire carrier moveable between a first position wherein the carrier outlet is adjacent the outlet and a second position wherein the carrier inlet is adjacent the hopper opening, wherein the entire carrier is moveable relative to the first plate, wherein the one or more hoppers are moveable relative to the carrier and the first plate, the container containing at least one item of value therein; and a controller operatively coupled to said display unit, said value input device, and said value output device, said controller comprising a processor and a memory operatively coupled to said processor, said controller being programmed to allow a person to make a wager, said controller being programmed to cause a video image to be generated on said display unit, said video image representing a game, said controller being programmed to determine, after said video image has been displayed, a value payout associated with an outcome of said game represented by said video image, said controller being programmed to move the first plate from the first position to the second position with the carrier in the second position to permit one and only one container to enter the receptacle in the carrier, said controller being programmed to move the first plate from the second position to the first position, said controller being programmed to move the entire carrier from the second position to the first position wit the first plate in the second position to provide the value payout in the form of the at least one item of value contained in the one and only one container, and said controller being programmed to move the one or more hoppers relative to the hopper opening.

14. The gaming apparatus as defined in claim 13, further comprising a housing having an inside and an outside, the display unit, the value input, and the controller disposed in the housing and the value output device attached to the outside of the housing.

15. The gaming apparatus as defined in claim 13, further comprising a housing, the display unit, the value input, and the controller disposed in the housing, and the value output device spaced from the housing.

16. The gaming apparatus as defined in claim 13, further comprising a platform rotatably mounted to the frame, the one or more hoppers attached to the platform.

17. The gaming apparatus as defined in claim 16, further comprising a plurality of hoppers, including the one or more hoppers, attached to the platform.

18. The gaming apparatus as defined in claim 17, wherein each of the hoppers has a plurality of containers disposed therein, each of the plurality of containers disposed in each of the hoppers containing at least one item of a different value.

19. The gaming apparatus as defined in claim 17, the platform having a central core and the plurality of hoppers attached to and spaced about the central core.

20. The gaming apparatus as defined in claim 13, further comprising first and second motors, the first motor coupled to the first plate and a second motor coupled to the carrier.

21. The gaming apparatus as defined in claim 20, wherein the first plate is slideable relative to the hopper opening between the first and second position, and the carrier is slideable between the outlet and the hopper opening.

22. The gaming apparatus as defined in claim 21, wherein the first and second motors comprise first and second linear actuators.

23. The gaming apparatus as defined in claim 22, wherein the controller is coupled to the first and second motors:

the controller being programmed to move the plate between the first and second positions with the carrier aligned with the hopper opening; and the controller being programmed to move the carrier between the hopper opening and the outlet with the plate in the first position.

24. The gaming apparatus as defined in claim 13, wherein the carrier has a first opening disposed on a first side of the carrier, alignable and disposable in communication with the hopper opening, and a second opening on a second, opposite side of the carrier, alignable and disposeable in communication with the outlet, the first opening in communication with the second opening.

25. A gaming apparatus, comprising:

a display unit that is capable of generating video images;

a value input device;

a value output device comprising:

a frame, one or more hoppers mounted to the frame and adapted to hold one or more containers, the one or more hoppers moveable relative to a hopper opening, an outlet spaced from the hopper opening, a first plate moveable relative to the hopper opening between a first position wherein the first plate blocks the hopper opening and a second position wherein the first plate is spaced from the hopper opening, and a carrier having a receptacle formed to receive one and only one container therein from one of the hoppers and defining a carrier inlet and a spaced carrier outlet to the receptacle, the entire carrier moveable between a first position wherein the carrier outlet is adjacent the outlet and a second position wherein the carrier inlet is adjacent the hopper opening, wherein the entire carrier is moveable relative to the first plate, wherein the one or more hoppers are moveable relative to the carrier and the first plate, the container containing at least one item of value therein; and a controller operatively coupled to said display unit, said value input device, and said value output device, said controller comprising a processor and a memory operatively coupled to said processor, said controller being programmed to allow a person to make a wager, said controller being programmed to allow a person to make a payline selection, said controller being programmed to cause a video image to be generated on said display unit, said video image comprising a plurality of simulated slot machine reels of a slots game, each of said slot machine reels having a plurality of slot machine symbols, said controller being programmed to determine a value payout associated with an outcome of said slots game, said controller being programmed to determine said outcome of said slots game based on a configuration of said slot machine symbols, said controller being programmed to move the first plate from the first position to the second position with the carrier in the second position to permit one and only one container to enter the receptacle in the carrier;

said controller being programmed to move the first plate from the second position to the first position, said controller being programmed to move the entire carrier from the second position to the first position with the first plate in the second position to provide the value payout in the form of the at least one item of value contained in the one and only one container, and said controller being programmed to move the one or more hoppers relative to the hopper opening.

26. The gaming apparatus as defined in claim 25, further comprising a housing having an inside and an outside, the display unit, the value input, and the controller disposed in the housing and the value output device attached to the outside of the housing.

27. The gaming apparatus as defined in claim 25, further comprising a housing, the display unit, the value input, and the controller disposed in the housing, and the value output device spaced from the housing.

28. The gaming apparatus as defined in claim 25, further comprising a platform rotatably mounted to the frame, the one or more hoppers attached to the platform.

29. The gaming apparatus as defined in claim 28, further comprising a plurality of hoppers, including the one or more hoppers, attached to the platform.

30. The gaming apparatus as defined in claim 29, wherein each of the hoppers has a plurality of containers disposed therein, each of the plurality of containers disposed in each of the hoppers containing at least one item of a different value.

31. The gaming apparatus as defined in claim 29, the platform having a central core and the plurality of hoppers attached to and spaced about the central core.

32. The gaming apparatus as defined in claim 25, further comprising first and second motors, the first motor coupled to the first plate and a second motor coupled to the carrier.

33. The gaming apparatus as defined in claim 32, wherein the first plate is slideable relative to the hopper opening between the first and second position, and the carrier is slideable between the outlet and the hopper opening.

34. The gaming apparatus as defined in claim 33, wherein the first and second motors comprise first and second linear actuators.

35. The gaming apparatus as defined in claim 34, wherein the controller is coupled to the first and second motors:

the controller being programmed to move the plate between the first and second positions with the carrier aligned with the hopper opening; and the controller being programmed to move the carrier between the hopper opening and the outlet with the plate in the first position.

36. The gaming apparatus as defined in claim 25, wherein the carrier has a first opening disposed on a first side of the carrier, alignable and disposable in communication with the hopper opening, and a second opening on a second, opposite side of the carrier, alignable and disposeable in communication with the outlet, the first opening in communication with the second opening.

37. A gaming apparatus as defined in claim 25 wherein said controller is programmed to allow a user to select a number of paylines.

* * * * *

UNITED STATES PATENT AND TRADEMARK OFFICE

CERTIFICATE OF CORRECTION

PATENT NO. : 7,682,238 B2
APPLICATION NO. : 10/244791
DATED : March 23, 2010
INVENTOR(S) : Russell Chudd et al.

It is certified that error appears in the above-identified patent and that said Letters Patent is hereby corrected as shown below:

In line 3 of claim 8 (column 18, line 32) change "carder" to --carrier--.

Signed and Sealed this

Seventh Day of September, 2010

David J. Kappos

David J. Kappos
*Director of the United States Patent and Trademark Office*